US011976574B2

(12) United States Patent
Tuckey

(10) Patent No.: US 11,976,574 B2
(45) Date of Patent: May 7, 2024

(54) CLOSED LOOP STEAM ENGINE ASSEMBLY WITH FEEDBACK FEATURES AND METHOD OF OPERATION

(71) Applicant: Charles Tuckey, Cass City, MI (US)

(72) Inventor: Charles Tuckey, Cass City, MI (US)

( * ) Notice: Subject to any disclaimer, the term of this patent is extended or adjusted under 35 U.S.C. 154(b) by 0 days.

(21) Appl. No.: 18/067,884

(22) Filed: Dec. 19, 2022

(65) Prior Publication Data

US 2023/0193792 A1 Jun. 22, 2023

Related U.S. Application Data

(60) Provisional application No. 63/292,678, filed on Dec. 22, 2021, provisional application No. 63/292,738, filed on Dec. 22, 2021.

(51) Int. Cl.

| | |
|---|---|
| ***F01K 13/00*** | (2006.01) |
| ***F01K 15/02*** | (2006.01) |
| ***F01K 19/02*** | (2006.01) |

(52) U.S. Cl.

CPC ..... *F01K 19/02* (2013.01); *F01K 13/00* (2013.01); *F01K 15/02* (2013.01)

(58) Field of Classification Search

CPC ..... F01K 19/02; F01K 13/00; F01K 15/02
See application file for complete search history.

(56) References Cited

U.S. PATENT DOCUMENTS

| | | | | |
|---|---|---|---|---|
| 4,479,354 | A * | 10/1984 | Cosby | F01K 19/02 60/645 |
| 2006/0064976 | A1* | 3/2006 | Sakita | F01B 29/12 60/519 |
| 2008/0022681 | A1* | 1/2008 | Tafas | F01K 23/10 60/618 |
| 2012/0159951 | A1* | 6/2012 | Avery | F01K 15/02 60/670 |
| 2014/0190154 | A1* | 7/2014 | Berger | F01M 13/04 60/370 |
| 2015/0247427 | A1* | 9/2015 | Takahashi | F01K 13/02 60/663 |
| 2016/0319691 | A1* | 11/2016 | Aumann | F01D 17/00 |

FOREIGN PATENT DOCUMENTS

CN 106014517 A * 10/2016

* cited by examiner

*Primary Examiner* — Matthew T Largi
(74) *Attorney, Agent, or Firm* — Dickinson Wright PLLC; Robert L. Stearns

(57) ABSTRACT

A closed loop steam engine assembly includes a steam generator and a prime mover which is driven from steam produced by the generator. A compressor receives exhaust steam from the prime mover and compresses the steam to a liquid state which is stored in a reservoir downstream of the compressor. A feed pump delivers a portion of the compressed and heated liquid from the reservoir to the steam generator, while another portion of the liquid is delivered to an inlet of the compressor, where the liquid flashes to mist and combines with the incoming exhaust steam to help condense the exhaust steam to liquid with greater efficiency than the compressor alone. An oil/fluid separation device may segregate any oil contained in the exhaust stream and route the oil back to an oil inlet of the prime mover.

8 Claims, 2 Drawing Sheets

CLOSED LOOP STEAM ENGINE ASSEMBLY WITH FEEDBACK FEATURES AND METHOD OF OPERATION

CROSS-REFERENCE TO RELATED APPLICATION

Figure 1:
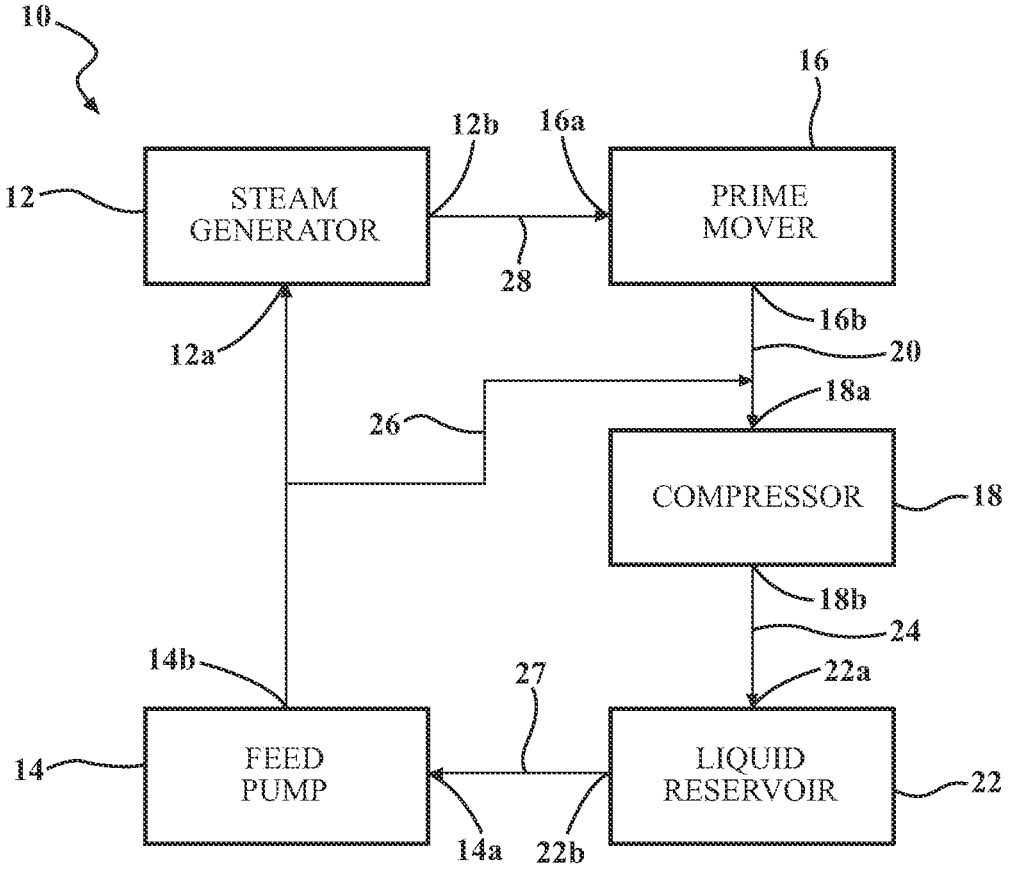

This U.S. Utility Patent Application claims priority to U.S. Provisional Application Ser. No. 63/292,678, filed Dec. 22, 2021 and U.S. Provisional Application Ser. No. 63/292,738, filed Dec. 22, 2021, the entire contents of each which are incorporated herein by reference.

BACKGROUND OF THE INVENTION

1. Technical Field

This application relates generally to closed loop steam engines and to methods for operating closed steam engine assemblies.

2. Related Art

In a steam engine assembly, a fluid, such as water, is heated above it boiling point to produce steam and is then fed into a prime mover, such as a power cylinder assembly of a vehicle, which converts the potential energy from the pressurized steam into mechanical power. In some engines, the steam flows through an open loop system and the unused steam is expelled out of the prime mover into the atmosphere. In closed loop systems, the spent steam is condensed to liquid and then fed back to the steam generator and back to the prime mover. With both systems, there are inherent inefficiencies due to energy loss.

An object of the present invention is to improve the energy efficiency and performance of closed loop steam engine assemblies.

SUMMARY OF THE INVENTION

A closed loop steam engine assembly comprises a steam generator that includes a heat source which heats a liquid above its boiling point to produce a supply of pressurized steam at a steam outlet of the steam generator. The assembly includes a prime mover having a steam inlet operatively coupled with the steam outlet of the steam generator for converting potential energy of the pressurized steam into mechanical power by the prime mover. The prime mover includes an exhaust outlet for expelling exhausted steam from the prime mover at a relatively lower pressure than the steam introduced to the prime mover at the steam inlet. The assembly includes a compressor having a steam inlet operatively coupled with the exhaust outlet of the prime mover for receiving and compressing the exhausted steam into a heated liquid. The assembly includes a liquid reservoir operatively coupled with an outlet of the compressor for receiving and storing the compressed liquid expelled from the compressor in the compressed state. The assembly includes a feed pump having an inlet operatively coupled with an outlet of liquid reservoir, the feed pump having an outlet operatively coupled to an inlet of the steam generator for delivering at least a portion of the liquid from the liquid reservoir to the steam generator. The assembly includes a liquid feedback line communicating between the liquid reservoir and the compressor for returning another portion of the liquid from the liquid reservoir to the compressor.

An advantage of the improved closed loop steam engine is that the portion of the compressed, heated liquid returned to the compressor flashes to mist when entering the compressor and aids in condensing the exhausted wet steam from the prime mover to liquid (i.e., supplemental or pre-condensing od the wet steam) within the compressor, thereby increasing the efficiency of the compressor and system without external energy inputs.

According to a further aspect, such a closed loop steam engine assembly may include an oil separation device for separating any oil present in the exhaust steam from the prime mover from the fluid stream and returning the oil to the prime mover. One embodiment includes an oil/fluid membrane preferably associated with the liquid reservoir which captures separated oil which is then fed back to an oil inlet of the prime mover. An advantage of this aspect of the invention includes the accommodation of oil in the exhaust stream, which may be present, for example, when the prime mover is a vane or Gerotor pump. A further advantage is that at least some of the exhausted oil can be captured and returned for use in the prime mover for improved efficiency and cost reduction.

THE DRAWINGS

Figure 2:
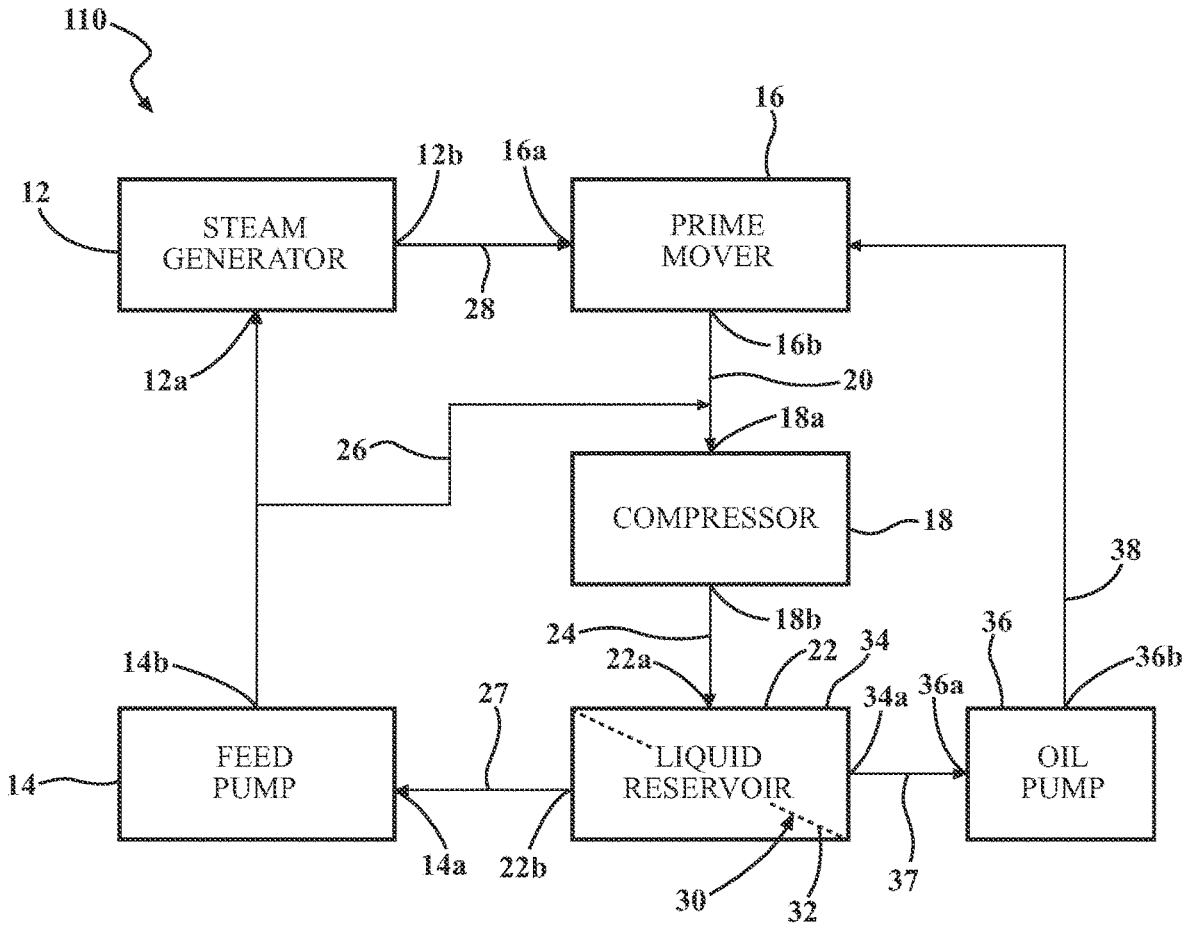

These and other features and advantages are further described in connection with the following detailed description and drawings, in which:

FIG. 1 is a flow chart showing a closed-loop steam engine assembly and method according to one aspect of the disclosure; and FIG. 2 is a flow chart like FIG. 1 but including the feature of oil feedback to the prime mover.

DETAILED DESCRIPTION OF EMBODIMENTS OF THE INVENTION

Referring to the Figures, wherein like numerals indicate corresponding parts throughout the several views, FIG. 1 illustrates a flow chart of a closed-loop steam engine assembly 10 according to one embodiment. The assembly 10 includes a steam generator 12 that is constructed and operates to heat a predetermined fluid, such as water, above its boiling point to generate a supply of heated steam. The liquid is fed into the steam generator 12 by a feed pump 14 which delivers the steam from the steam generator 12 under pressure to a prime mover 16. The steam generator 12 may including a heating source, such as a gas or electric boiler or other source of energy for heating the liquid to a target temperature above it boiling point to produce the steam. As will be apparent from the full description below, the closed loop construction of the assembly is more efficient than an open loop design because it is designed to feed heated liquid into the steam generator 12, thereby greatly reducing the energy required to boil that liquid into steam.

The prime mover 16 may comprise any of a number of devices which are able to convert the potential energy of the steam input into mechanical power. Such prime mover devices 16 may include a power cylinder-type steam engine, a rotary-type steam engine, a vane pump, a Gerotor pump, or a turbine, for example. The engines may be used for propelling vehicles or for driving energy generation systems such as commercial, industrial or residential generators. The prime mover 16 may include any device which generates an output, mechanical, electrical or otherwise, in response to pressurized steam input, and thus the scope of the invention is not to be limited to any particular type of prime mover.

One non-limiting example of the prime mover 16 may comprise a steam engine for a vehicle such as an automobile, truck, or heavy equipment.

The prime mover 16 includes a steam inlet 16*a* for receiving the steam from the steam generator and an exhaust outlet 16*b* for expelling exhausted steam from the prime mover 16. The steam exiting the prime mover 16 at the outlet 16*b* is at a lower pressure than the steam introduced to the prime mover 16 at the steam inlet 16*b*. The temperature of the exhaust steam may also be relatively lower than that of the steam introduced at the inlet, with the losses contributing to the generation of mechanical power by the prime mover 16.

A compressor 18 is arranged downstream of the prime mover 16. The compressor 18 includes an inlet 18*a* that is operatively coupled to the outlet 16*b* of the prime mover 16, such as by a sealed supply line 20. The compressor 18 compresses (i.e., increases the pressure of) the low pressure wet steam exhausted from the prime mover until it condenses to a heated liquid. Without substantially cooling the liquid, the compressor 18 feeds the liquid to a liquid reservoir 22 via a sealed fluid line 24 coupled between an outlet 18*b* of the compressor 18 and an inlet 22*a* of the fluid reservoir 22. The liquid reservoir 22 stores the fluid at an elevated temperature.

The sealed pump 14 delivers a portion of the fluid from the liquid reservoir 22 to the steam generator 12 as previously described. The delivery may be by way of a fluid delivery line 25. Another portion of the fluid is delivered to the inlet of the compressor 18 via a sealed feedback line 26, which may branch off from the fluid delivery line 25. In the exemplary embodiment, the feed pump 14 is downstream of the liquid reservoir 22 and coupled at respective inlets 14*a* and outlets 22*b* thereof by a pump line 27. The fluid delivery line 25 may be coupled to an outlet 14*b* of the feed pump at one end and to an inlet 12*a* of the steam generator 12. A further sealed steam supply line 28 may extend from an outlet of the steam generator 12*b* to the inlet 16*a* of the prime mover 16.

The heated fluid under pressure from the liquid reservoir 22, upon arriving at the compressor 18, is caused to at least partially decompress and to flash to a mist as it mixes with the stream of wet exhaust steam coming into the compressor 18 from the prime mover 14. A synergistic effect is realized, as the heated flash of mist from the liquid agglomerates combines with and helps pre-condense the exhaust steam toward the liquid state as it passes through the compressor 18, thereby reducing the external energy input on the compressor that would otherwise be required in order to condense the exhaust steam to the liquid state. A net savings in energy and reduction in time is thus realized by introducing the feedback stream of compressed hot liquid at the compressor inlet 18*a*.

FIG. 2 illustrates an alternative embodiment of a closed loop steam engine assembly 110. The second embodiment may be identical in all respects of construction and operation to the first embodiment, but with the added feature of an oil capture and feedback feature. The same reference numerals are employed to identify like components and features as are used in FIG. 1 and thus the descriptions thereof are incorporated by reference and will not be repeated. The embodiment of FIG. 2 differs in that it includes an oil/liquid separation device 30. The oil/liquid separation device functions to separate oil from the liquid. The oil may be present in the exhaust stream coming from the prime mover 16, such as a vane motor, where the vane motor moving parts are moved under the pressure of applied steam while lubricated with oil to reduce wear and increase efficiency of the motor. Some of the oil will mix and escape with the exhaust gas and be passed through the compressor 18 and into the liquid reservoir 22. The oil/liquid separation device may comprise a membrane 32 which may operate to enable the passage of liquid through the membrane 32 while blocking the passage of oil. The membrane 32 may be provided in the liquid reservoir 22 and may form an operative partition within the liquid reservoir 22, providing an oil separation portion 34 of the reservoir 22 apart from the liquid. A sealed line 37 may extend from an outlet 34*a* of the oil separation portion 34 to an inlet 36*a* of an oil pump 36, and a further line 38 may extend from an outlet 36*b* of the oil pump 36 to an oil inlet 16*c* of the prime mover 16 for pumping the separated oil from the reservoir 22 back to the prime mover 16. This feature has the advantage of recapturing exhausted oil and feeding it back to the prime mover 16 for reuse by the prime mover 16. The oil feedback feature also removes the oil upstream of the steam generator 12 to avoid potential volatilization or breakdown of the oil in the steam generator environment.

Obviously, many modifications and variations of the present invention are possible in light of the above teachings. It is, therefore, to be understood that the invention may be practiced otherwise than as specifically described while still being within the scope of the invention.

What is claimed is:

1. A closed loop steam engine assembly, comprising:

a steam generator including a heat source which heats a liquid above its boiling point to produce a supply of pressurized steam at a steam outlet of the steam generator;

a prime mover having a steam inlet operatively coupled with the steam outlet of the steam generator for converting potential energy of the pressurized steam into mechanical power by the prime mover, the prime mover including an exhaust outlet for expelling exhausted steam from the prime mover at a relatively lower pressure than the steam introduced to the prime mover at the steam inlet;

a compressor having a steam inlet operatively coupled with the exhaust outlet of the prime mover for receiving and compressing the exhausted steam into a heated liquid;

a liquid reservoir operatively coupled with an outlet of the compressor for receiving and storing the compressed liquid expelled from the compressor in the compressed state;

a feed pump having an inlet operatively coupled with an outlet of the liquid reservoir, the feed pump having an outlet operatively coupled to an inlet of the steam generator for delivering a first portion of the liquid from the liquid reservoir to the steam generator; and a liquid feedback line communicating between the outlet of the feed pump and the inlet of the compressor and bypassing the steam generator and prime mover to deliver a second portion of the liquid from the pump directly to the compressor without first passing through the steam generator and the prime mover.

2. The assembly of claim 1, wherein the prime mover is an engine for a vehicle.

3. The assembly of claim 1, wherein the prime mover is a vane or Gerotor pump or motor.

4. The assembly of claim 1, wherein the prime mover is an engine for an electrical generator.

5. The assembly of claim 1, including an oil/liquid separator operating to separate any oil present in the exhausted steam from the compressed liquid.

6. The assembly of claim 5, wherein the oil/liquid separator device comprises a membrane that allows for the passage of the compressed liquid but not the oil to define an oil separation portion of the liquid reservoir.

7. The assembly of claim 6, wherein the membrane is disposed in the liquid reservoir.

8. The assembly of claim 7, including an oil pump communicating with the oil separation portion of the liquid reservoir for pumping the separated oil portion to an oil inlet of the prime mover.

* * * * *